US007954288B2

(12) United States Patent
Gosling et al.

(10) Patent No.: US 7,954,288 B2
(45) Date of Patent: Jun. 7, 2011

(54) CUSTOM CONNECTION SYSTEM FOR MODULAR WALLS

(75) Inventors: Geoff Gosling, Calgary (CA); Mogens Smed, De Winton (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 755 days.

(21) Appl. No.: 11/855,363

(22) Filed: Sep. 14, 2007

(65) Prior Publication Data

US 2008/0066414 A1 Mar. 20, 2008

Related U.S. Application Data

(60) Provisional application No. 60/826,055, filed on Sep. 18, 2006, provisional application No. 60/826,044, filed on Sep. 18, 2006, provisional application No. 60/826,051, filed on Sep. 18, 2006.

(51) Int. Cl.
*E04B 1/38* (2006.01)
*E04C 3/00* (2006.01)

(52) U.S. Cl. ..... 52/282.2; 52/277; 52/282.3; 52/282.5; 52/283; 52/578

(58) Field of Classification Search ..... 52/282.2, 52/277, 282.3, 282.5, 283, 578, 582.2, 588.1
See application file for complete search history.

(56) References Cited

U.S. PATENT DOCUMENTS

| | | | | |
|---|---|---|---|---|
| 3,546,834 | A * | 12/1970 | Murawski | 52/632 |
| 4,035,972 | A * | 7/1977 | Timmons | 52/241 |
| 4,129,163 | A * | 12/1978 | Johnson | 160/135 |
| 6,415,566 | B2 * | 7/2002 | Auer | 52/238.1 |
| 2001/0004817 | A1 * | 6/2001 | Auer | 52/238.1 |
| 2003/0155083 | A1 | 8/2003 | MacDonald et al. | |

FOREIGN PATENT DOCUMENTS

CA 2602669 A1 3/2008

OTHER PUBLICATIONS

Office Action on CIPO Application No. 2,602,669, mailed Oct. 18, 2010.

* cited by examiner

*Primary Examiner* — Richard E Chilcot
*Assistant Examiner* — Mark R Wendell
(74) *Attorney, Agent, or Firm* — Workman Nydegger

(57) ABSTRACT

A virtual connector post (or customized wall module intersection) includes a variable angle connector assembled with a plurality of position retention mechanisms and a corresponding plurality of connector interfaces of corresponding wall modules. The virtual connector post can be varied for virtually any shape or design simply by varying the shape of the variable angle connector(s) used therein. In particular, the variable angle connector can be arbitrarily shaped so that the ultimately joined wall modules form a corresponding, non-standard angle, such as non-right angles between wall modules in a given partition. The variable angle connectors and corresponding position retention mechanisms can be securely fastened between multiple wall modules at any number of arbitrary points along the length of a partition.

9 Claims, 9 Drawing Sheets

CUSTOM CONNECTION SYSTEM FOR MODULAR WALLS

CROSS-REFERENCE TO RELATED APPLICATIONS

The present invention claims the benefit of priority to U.S. Provisional Patent Application No. 60/826,055, filed on Sep. 18, 2006, entitled "Custom Connection System for Modular Walls," and to U.S. Provisional Patent Application No. 60/826,051, filed on Sep. 18, 2006, entitled "Variable Connection System for Modular Wall Systems," and to U.S. Provisional Patent Application No. 60/826,044, filed on Sep. 18, 2006, entitled "Positional Retention Mechanism for Modular Wall Assembly." The entire content of each of the aforementioned patent applications is incorporated herein by reference.

BACKGROUND OF THE INVENTION

1. The Field of the Invention

Implementations of the present invention relate generally to systems and components for partitioning interior or exterior spaces.

2. Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices or conference rooms depending on the organization's needs and size constraints. Some organizations will prefer to build permanent walls and structures to partition the space, which can be prohibitively expensive and time consuming. Accordingly, other organizations will partition the space with modular assemblies that can be easily assembled and reconfigured as desired. Specifically, modular systems tend to be relatively inexpensive compared with the time, effort, and materials to build out a space and/or to reconfigure previously constructed walls as the organization's needs change.

For example, modular office partitions typically include a series of individual wall modules (or panels) that can be immediately placed into a particular partition position to create at least an outline of a cubicle, office, or conference room. That is, a manufacturer or assembler can typically take a given set of wall modules, and align the wall modules along a floor pattern until the desired configuration is achieved. The manufacturer can then secure the given wall modules in position. The assembled partitions can either free-standing, or can be rigidly attached to the permanent support structures.

Of course, it is typically the case that what modular systems provide in terms of easy assembly and re-configurability, the modular systems also give up in terms of creative flexibility. For example, typical modular systems are designed to connect together with only 0° or 90° angles between adjacent wall modules. If the organization desires any deviation from this, such as unconventional angles or even curvatures, the manufacturer or assembler will typically need to create custom connectors, or will otherwise need to improvise a solution with custom-shaped wall modules. Manufacturing custom connectors or wall modules, however, can be costly and time consuming. In addition, improvised solutions often fail to, for example, provide adequate sound protection and/or privacy between adjacent spaces and/or the desired aesthetics. Furthermore, customizing such systems can add significant costs, which otherwise defeats some of the main advantages of modular systems.

For example, typical modular systems are designed to use standard connector posts that allow modular wall assembly with either 0° or 90° angles therebetween. If two modular walls need to meet at a non-standard angle (i.e., not 0° or 90°), however, the manufacturer will typically need to create a custom connector post. In conventional systems, a manufacturer or installer will typically do so by creating a customized connector post out of an easily modifiable material such as wood. Unfortunately, in addition to the added costs of effort and time to create such a customized post, creating materials such as wood can also create difficulties with respect to certain fire safety (or other) building codes. This, of course, can involve additional effort time and cost to overcome. For example, the manufacturer might need to further treat the custom wood posts, such as with fire-retardant, or add certain materials to the custom wood posts.

Accordingly, there are a number of difficulties associated with dividing interior office space with modular systems. In particular, there are a number of difficulties present in terms of efficiently connecting adjacent panels and/or framing posts or other framing members when adjacent panels meet at non-standard angles.

BRIEF SUMMARY OF THE INVENTION

Implementations of the present invention overcome one or more problems in the art with apparatus, systems, and methods configured to provide flexibility in the design and layout of modular partitions. In particular, implementations of the present invention provide the ability to align multiple wall modules meeting at an intersection point at practically any arbitrary angle. For example, at least one implementation of the present invention comprises an easily customizable virtual connector post, whereby the combination of one or more connection devices and trim components allow the connection of intersecting partitions or wall modules with or without the use of a discreet post component or assembly. The virtual connector post can be readily assembled and reconfigured in an efficient manner as needed to accommodate virtually any angle in a partition or between wall modules.

For example, a virtual connector post in accordance with an implementation of the present invention can include at least one variable angle connector having a shape comprising three or more facing sides. The virtual connector post can also include a plurality of position retention mechanism arranged around a plurality of the facing sides. In addition, the virtual connector post can include a connector interface attached to each of the plurality of position retention mechanisms.

By contrast, a system configured to partition an interior or exterior space with a plurality of modular walls can include a set of one or more first variable angle connectors having a first shape. The system can also include a set of one or more first variable angle connectors having a second shape. In addition, the system can include a plurality of position retention mechanisms. Furthermore, the system can include a plurality of connector interfaces corresponding to each of the position retention mechanisms. The position retention mechanisms and the connector interfaces are configured for attachment to either the first or second variable angle connectors to create a custom connector post corresponding to the shape of the first or second variable angle connectors.

In addition, a method of creating a customizable, virtual connector post can include determining a partition arrangement, the partition arrangement comprising a plurality of wall modules, at least some of the wall modules intersecting at an intersection having a first shape. The method can also include identifying a set of one or more variable angle connectors that are consistent with the first shape. In addition, the method can include releasably attaching a plurality of position retention mechanisms to a plurality of sides on the one or more variable angle connectors. Furthermore, the method can include releasably attaching a corresponding plurality of connector interfaces to each of the plurality of position retention mechanisms. In this case, the plurality of connector interfaces will form a virtual connector post that conforms to the first shape.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
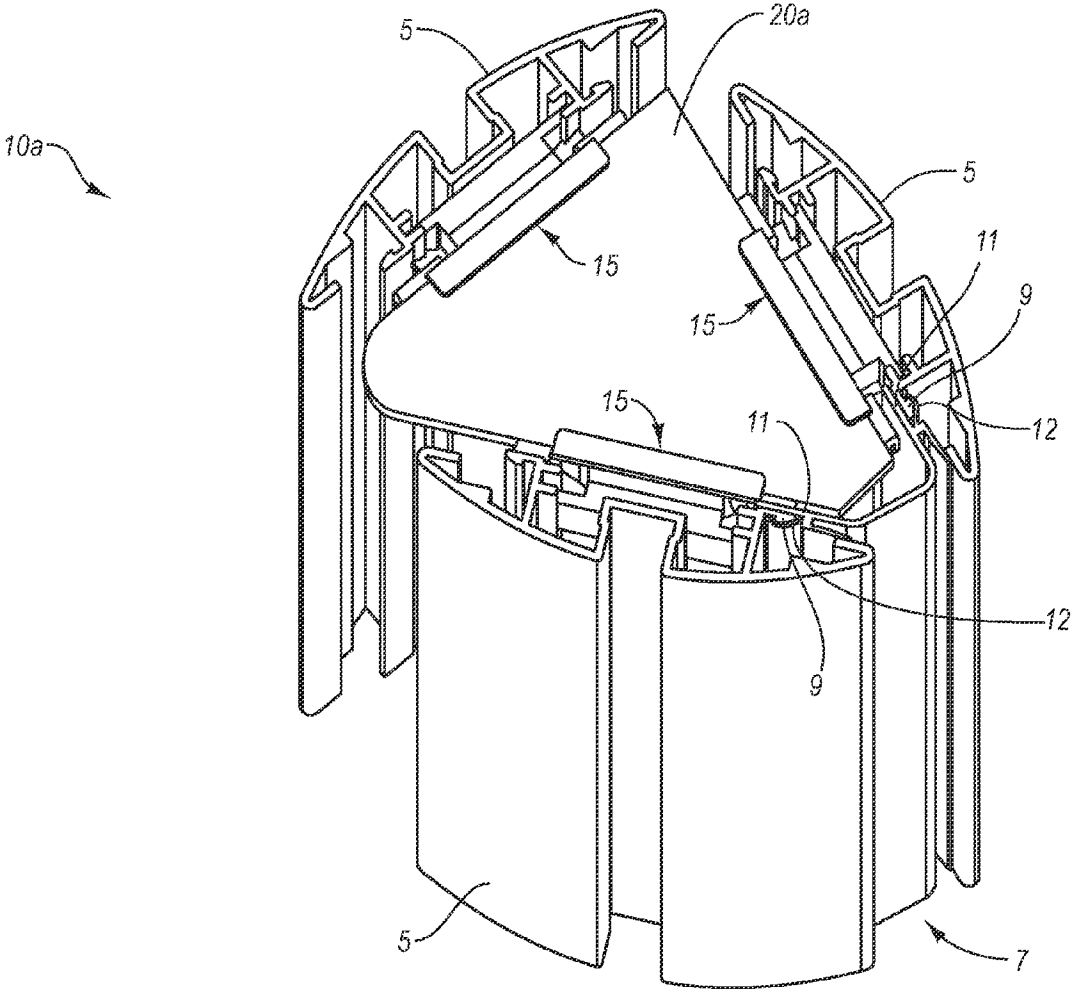
FIG. 1A illustrates an upside down perspective view of a customized wall module intersection in accordance with an implementation of the present invention in which a variable angle connector is used to join three connector interfaces of corresponding wall modules.

The present invention extends to apparatus, systems, and methods configured to provide flexibility in the design and layout of modular partitions. In particular, implementations of the present invention provide the ability to align multiple wall modules meeting at an intersection point at practically any arbitrary angle. For example, at least one implementation of the present invention comprises an easily customizable virtual connector post, whereby the combination of one or more connection devices and trim components allow the connection of intersecting partitions or wall modules with or without the use of a discreet post component or assembly. The virtual connector post can be readily assembled and reconfigured in an efficient manner as needed to accommodate virtually any angle in a partition or between wall modules.

As used herein, the term "virtual connector post" generally refers to an assembly of modular walls and corresponding connector interfaces about a customized intersection alignment. That is, the components described herein can be used to create the semblance of a traditional connector post since wall modules are joined at an intersection point. Nevertheless, and as will be understood more fully herein, no actual, full-length connector post need necessarily be created, as such, to join the wall modules. In particular, one will appreciate that a discrete, separable connector post can also be created in accordance with implementations of the present invention using a plurality of connector interfaces (e.g., detached from a wall module) or the like and an appropriate set of variable angle connectors. As such, the customized intersection of wall modules can be understood to be a virtual connector post just as much as a discrete, independent connector post that is separable from the component wall modules.

In any event, this ability to configure partitions using a virtual connector post (or independent connector post) can be accomplished at least in part using a variety of relatively simple, easy to install components. For example, in at least one implementation of the present invention, a virtual connector post comprises: (i) a variable angle connector (or connection plate) having a plurality of sides of any shape or arbitrary orientation, (ii) at least one position retention mechanism for a plurality of sides of the variable angle connector, and (iii) a set of corresponding connector interfaces. These components, when assembled together, provide a virtual (or actual, independent) connector post that conforms to the geometry of the variable angle connector, and thus an interface (or customized intersection) for connecting wall modules in the geometry of the variable angle connector.

Along these lines, one will appreciate that at least one aspect of the present invention, therefore, is that the shape or geometry of the variable angle connector can include both standard angles (i.e., 0°, 90°, or 180°), as well as at non-standard angles (e.g., 5°, 45°, 75°, etc.) This variability is enhanced by the fact that the variable angle connector can be easy to manufacturer in customized formations. In particular, the variable angle connector can be a relatively simple component that can be easily manufactured in mass in virtually any set of angles, and without incurring any great expense.

As such, a manufacturer or installer can readily assemble a virtual connector post during installation or partitioning of a given space with relative ease, expense, and efficiency using a set of preexisting components. For example, a manufacturer can determine a partition layout during installation, then choose a corresponding variable angle connector (or set of connectors) for an intersection of wall modules. Once the installer has chosen variable angle connectors that are appropriate for the wall module intersections, the manufacturer can create the connector post, and even reconfigure the connector post (i.e., reconfigure the intersection shape/dimensions between wall modules) into a new shape, as needed.

Figure 1B:
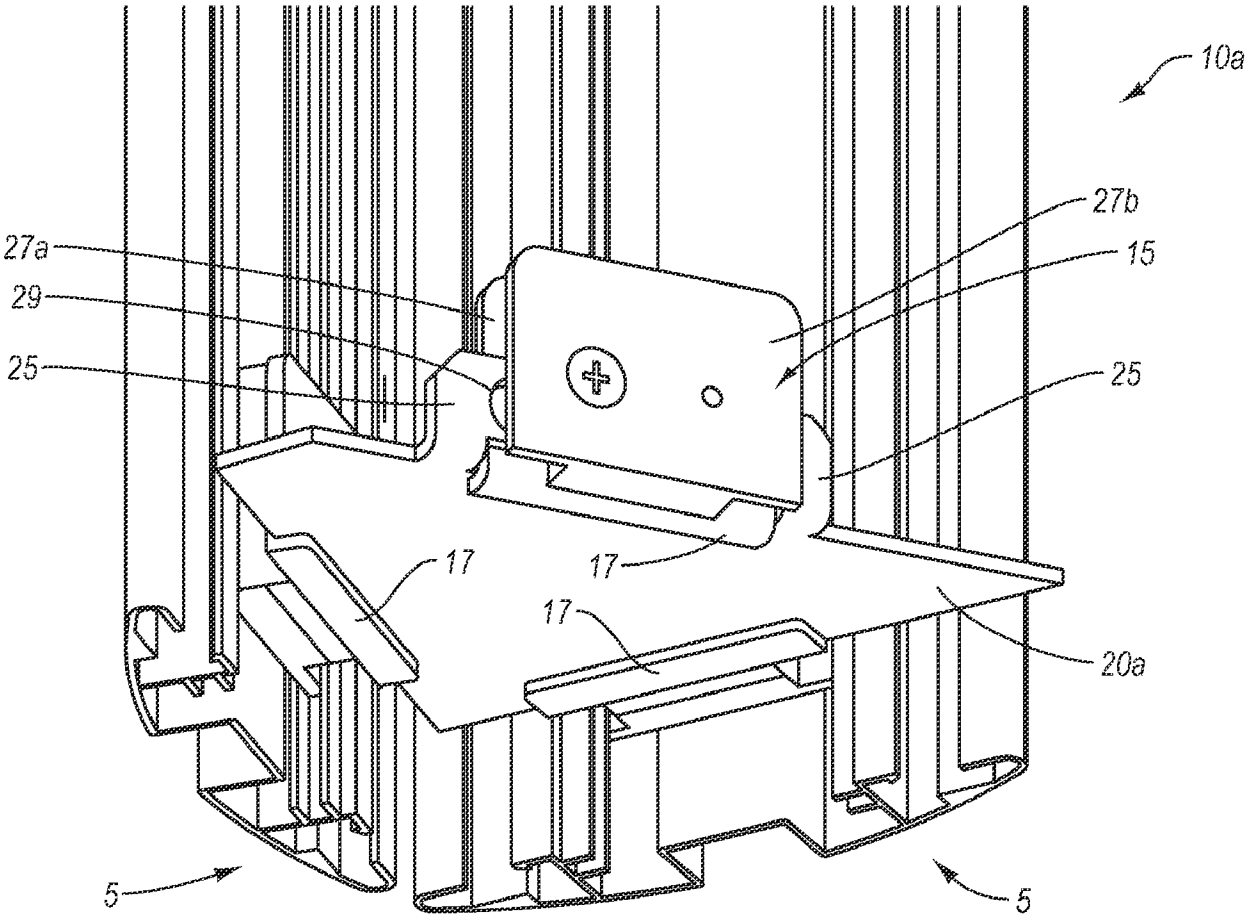
FIG. 1B illustrates a right side up perspective view of the wall module intersection illustrated in FIG. 1A in which a wall module (and corresponding connector interfaces) has been removed to show the variable angle connector.

Referring now to the Figures, FIGS. 1A and 1B illustrate perspective views of a virtual connector post 10*a* that has been assembled with components in accordance with an implementation of the present invention. As shown in both FIGS. 1A and 1B, an exemplary virtual connector post 10*a* can comprise a system of modular components that can readily be assembled to address a given situation where wall modules meet at non-standard angles and/or with non-standard spacing. One will appreciate, however, that the components illustrated or otherwise described herein can be used to join wall modules at standard angles and/or standard spacing, such as where a virtual connector post is preferable (e.g., for cost savings). In particular, FIG. 1A shows a bottom view of virtual connector post 10*a* with the components centralized around a variable angle connector 20*a*. In general, a typical virtual connector post 10*a* will have at least one variable angle connector 20*a* at one or more positions along the length of thereof (see also FIG. 2C). For example, a manufacturer may choose to position one variable angle connector 20*a* at the top of a connector post and another at the bottom of the virtual connector post.

In this particular illustration of FIGS. 1A and 1B, variable angle connector 20*a* comprises a triangular shape, though one will appreciate that a connector 20*a* can have essentially any shape (e.g., FIGS. 4A-4D). By way of explanation, one will appreciate that the variable angle connector 20*a* will generally comprise a sufficiently rigid plate comprised of a material for holding an intersection between wall modules with sufficient firmness. For example, the variable angle connector 20 can comprise a sheet metal, and/or any other number or type of sufficiently rigid plastic or rubber materials (or combinations thereof). In general, the materials for the variable angle connector (and/or any other components described herein) are chosen such that it can be easily and efficiently shaped during manufacturing to a particular angle (or set of angles), but otherwise maintain a rigid shape during assembly of a virtual connector post 10.

In addition, FIG. 1A shows that virtual connector post 10*a* comprises a plurality of position retention mechanisms 15. In general, each position retention mechanism 15 is configured to attach to the variable angle connector 20*a* at a plurality of variable angle connector edges. Each position retention mechanism 15 is also configured to attach to a corresponding connector interface 5. For example, FIG. 1A shows that each position retention mechanism 15 couples a connector interface 5 of a wall module (not shown) to the variable angle connector 20*a* at each edge (or edge face). By contrast, and for purposes of illustration, FIG. 1B illustrates a top view in which at least one position retention mechanism 15 is connected just to the variable angle connector 20*a*, but not at the same time to a corresponding connector interface. In any event, FIGS. 1A and 1B show that each position retention mechanism 15 forms a bridge between the given connector interface 5 and the variable angle connector 20.

As a preliminary matter, FIGS. 1A-2B show the connector interfaces 5 in isolation (rather than coupled with or extending from a wall module) around the customized intersection created using the variable angle connector 20. One will appreciate that this is done primarily by way of convenience. For example, and as previously mentioned, at least one implementation of a connector interface 5 will be an extension of a wall module edge (e.g., FIG. 2C), rather than a separate component that is conceivably attached to a wall module separately. Of course, it is possible in accordance with the present invention that a connector interface 5 could be used in conjunction with a pre-existing wall module that is not formed or created with the connector interface 5.

In any event, at least one method of creating a connector post (or virtual connector post) includes determining a partition arrangement shape. For example, a manufacturer may determine, based on a particular partition design layout, that a triangular intersection will be needed between wall modules, and thus the intersection needs a triangular virtual connector post (e.g., 10*a*). The manufacturer then identifies a set of one or more variable angle connectors 20 that are consistent with the first shape, and releasably attaches a plurality of position retention mechanisms 15 to a plurality of sides of at least one variable angle connector 20. The manufacturer then releasably attaches a corresponding plurality of connector interfaces 5 (or corresponding wall modules) to each of the plurality of position retention mechanisms. As a result, the plurality of connector interfaces form a connector post (or virtual connector post) that conforms to the first shape.

In some cases, attachment of the connector interfaces about the variable angle connector 20 can result in gaps between adjacent connector interfaces, particularly depending on the shapes or dimensions of the variable angle connector 20. Accordingly, FIG. 1A also shows that the manufacturer or assembler can add one or more finishing or sealing components to virtual connector post 10*a*. For example, FIG. 1A shows that the manufacturer has inserted a flexible gasket 7 into the corresponding space between two connector interfaces 5.

In general, flexible gasket 7 can comprise any number or type of flexible sub-components that provide an appropriate range of both connection and spatial flexibility/separation between adjacent connector interfaces 5. For example, FIG. 1A shows that gasket 7 comprises a set of opposing walls 11 to which are attached a set of gripping elements 12. In at least one implementation, the gripping elements 12 extend along the entire length of opposing walls 11. Furthermore, the gripping elements 12 and walls 11 are of sufficient composition to allow for expansion and contraction, as well as releasable and yet secure attachment about rails 9 of two adjacent connector interfaces 5.

To this end, therefore, gasket 7 (and corresponding walls and gripping elements) can be made of virtually any number of synthetic or naturally occurring materials, including for example, metallic, rubber, and plastic materials, or composites thereof. In at least one implementation, the materials of gasket 7 are chosen so that gasket 7 can expand or contract to accommodate a fairly broad range of adjacent connector interface 5 separations/gaps. In addition, the material and design of gaskets 7 (or concealing strips 30, FIG. 3A-3B) can be chosen particularly to block air, light, or sound that would otherwise emanate through a connector post 10 to add privacy effects. Furthermore, the material can be chosen for structural stability. For example, FIG. 1A shows that gasket 7 provides an element of additional structural support by connecting to the rails 9 of two adjacent connector interfaces 5. One will appreciate that a manufacturer can use a single gasket 7 along the entire edge length of a particular gap, or can use multiple, smaller gaskets (not shown) along the same set of edges between two connector interfaces 5.

Figure 1C:
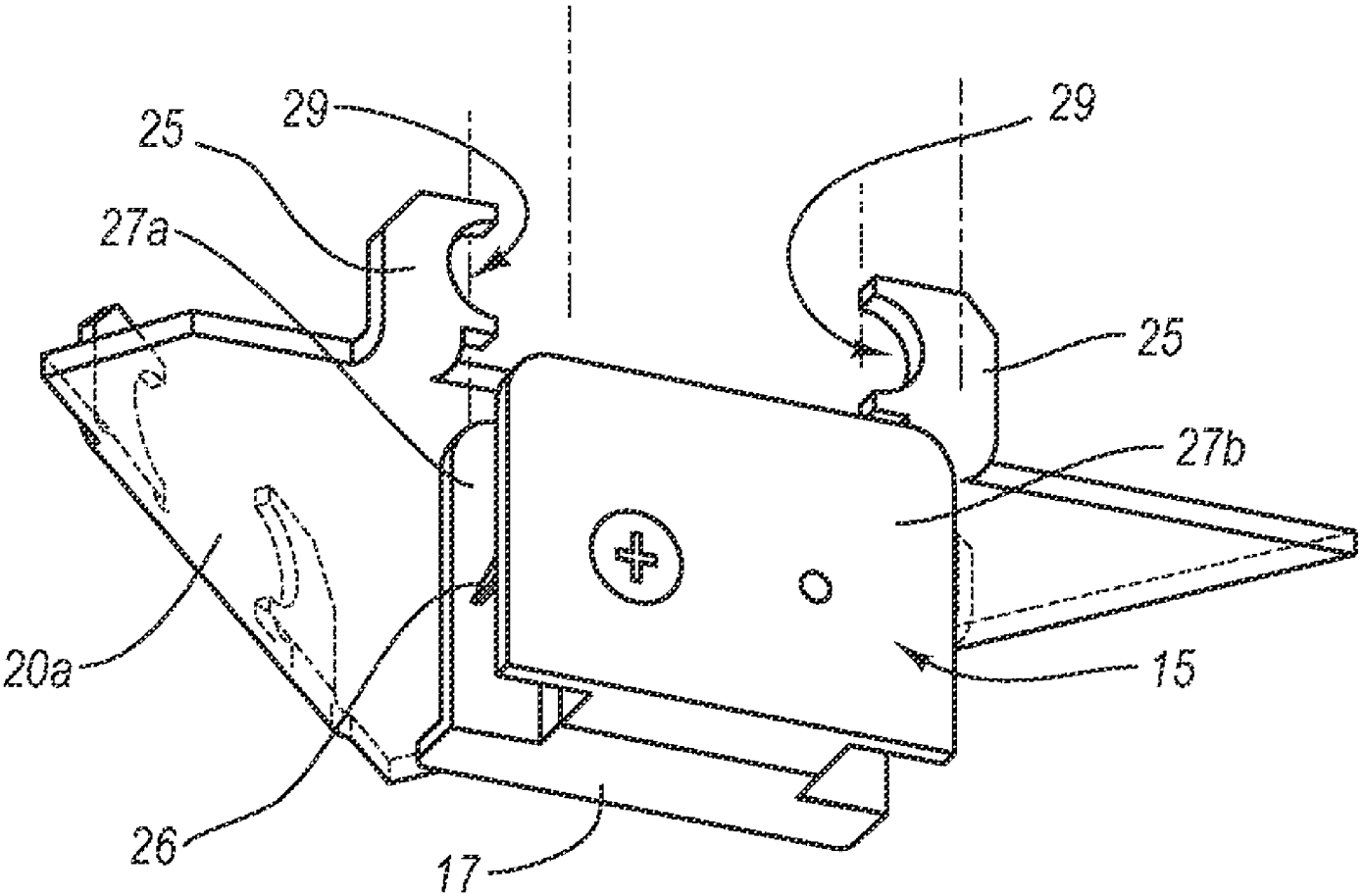
FIG. 1C illustrates a schematic view for connecting or attaching a position retention mechanism 15 to a variable angle connector.

FIG. 1C illustrates a schematic view for connecting or attaching a position retention mechanism 15 to variable angle connector 20*a*. As shown, an exemplary position retention mechanism 15 essentially comprises opposing first and second walls 27*a-b*. The opposing walls 27*a-b* form a plurality of opposing channels, and within the opposing channels are positioned a plurality of spring tabs 26. In general, the plurality of opposing channels are wide enough to accept at least raised tabs 25 as well as a portion of connector interface 5, such as a portion of rail 9 (e.g., FIG. 1A) of connector interface 5. Thus, for example, to attach a position retention mechanism 15 to the variable angle connector 20*a*, the manufacturer or assembler slides the raised tabs 25 through the channels of the position retention mechanism 15, or otherwise inserts wall 27*a* into a slot between tabs 25 and the main surface of variable angle connector 20*a*. The manufacturer also inserts wall 27*b* into a corresponding set of channels formed adjacent rails 9 of connector interface 5.

In either case, the manufacturer slides position retention mechanism 15 until the spring tabs 26 open within notches (or recesses) 29 of raised tabs 25 (and/or corresponding notches in a portion of rails 9). In particular, the spring tabs 26 are configured to releasably secure the position retention mechanism 15 to the notches 29 of raised tabs 25 (e.g., FIG. 1B). The plurality of spring tabs 26 are also configured to releasably secure the position retention mechanisms 15 at the same time into a similar plurality of notches (not shown) in the connector interface 5 rails 9. One will appreciate that position retention mechanism 15 can also thus be released from the variable angle connector 20*a* (and from the connector interface 5) by depressing the spring tab 26 (e.g., with an appropriate tool of appropriate size) and sliding the position retention mechanism 15 out of the notches of the raised tabs 25 and/or rails 9.

Thus, FIGS. 1B and 1C show that the position retention mechanism 15 supports or otherwise fixes the vertical position of the variable angle connector 20*a* with respect to a connector interface 5 through a notch and spring tab configuration. In addition to this configuration, FIGS. 1B and 1C also show that the position retention mechanisms 15 can fix a vertical position of the variable angle connector 20*a* with a right angle return 17. For example, FIGS. 1B and 1C show that a position retention mechanism 15 can include at least one right angle return 17 projecting perpendicularly from a wall (e.g., 27*a*) of the position retention mechanism 15. The right angle return 17 can directly support the main surface of the variable angle connector 20. As a result, the notch 29 and spring tab 26 interface combine with the right angle return 17 and variable angle connector 20 main surface to provide at least two points of vertical support for the variable angle connector 20.

Figure 2A:
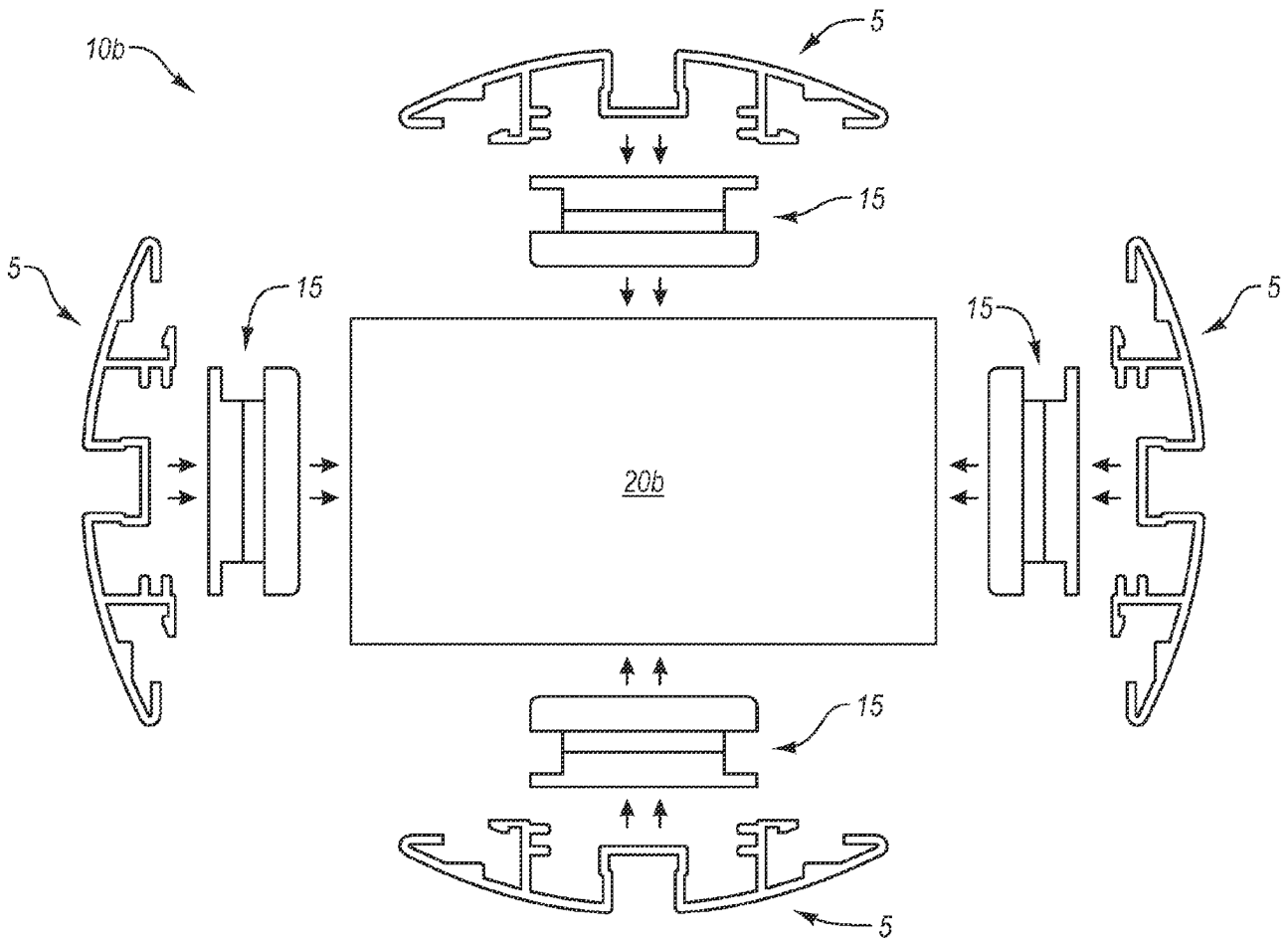
FIG. 2A illustrates an exploded bottom view of a customized wall module intersection in accordance with an implementation of the present invention in which a variable angle connector is used to join four wall modules.
Figure 2B:
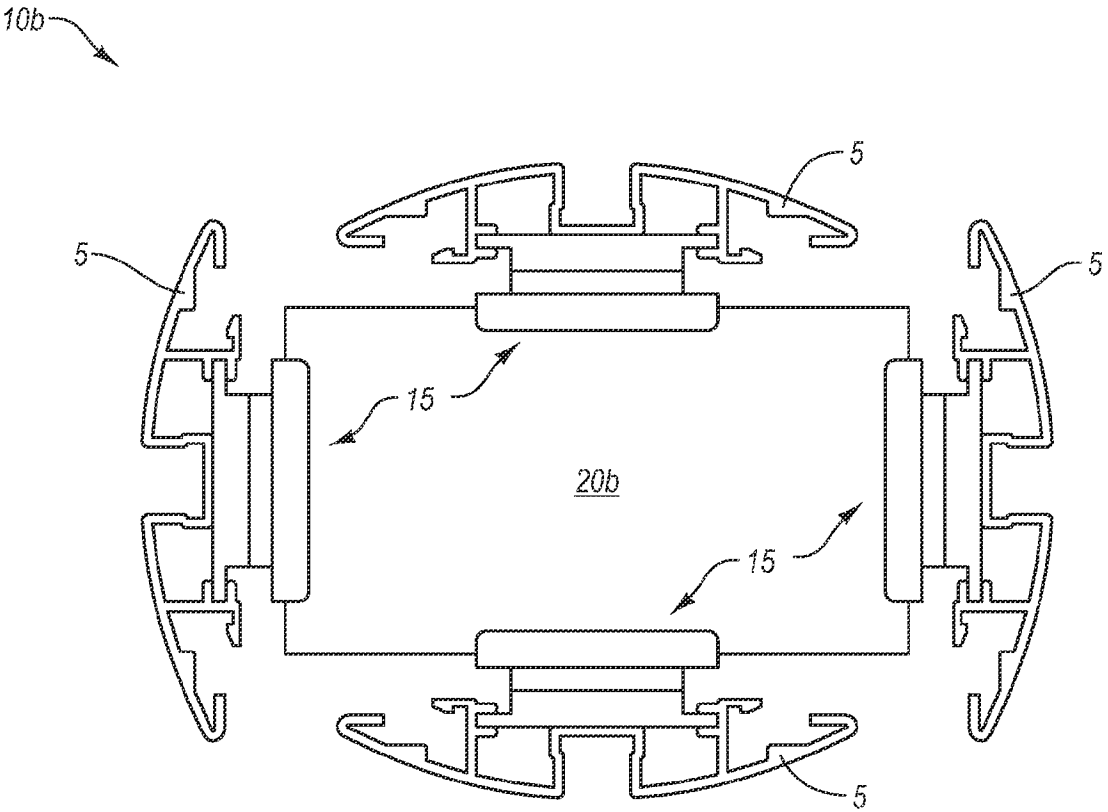
FIG. 2B illustrates assembled view of the customized intersection components depicted in FIG. 2A.

FIGS. 2A and 2B illustrate a sequence in which a manufacturer creates a connector post 10*b* (or virtual connector post) by attaching a plurality of position retention mechanisms 15 to a rectangular variable angle connector 20*b*, and subsequently attaching each connector interface 5 (e.g., of a corresponding wall module). In particular, FIG. 2A illustrates an exploded bottom view of a virtual connector post 10*b* before the components (connector 20, position retention mechanism 15, etc.) are assembled. By contrast, FIG. 2B depicts an assembled bottom view of virtual connector post 10*b* of FIG. 2A. In this example, virtual connector post 10*b* is configured to create a four-way intersection, or otherwise to join four wall modules (not shown) at each side of the given variable angle connector 20*b*.

Figure 2C:
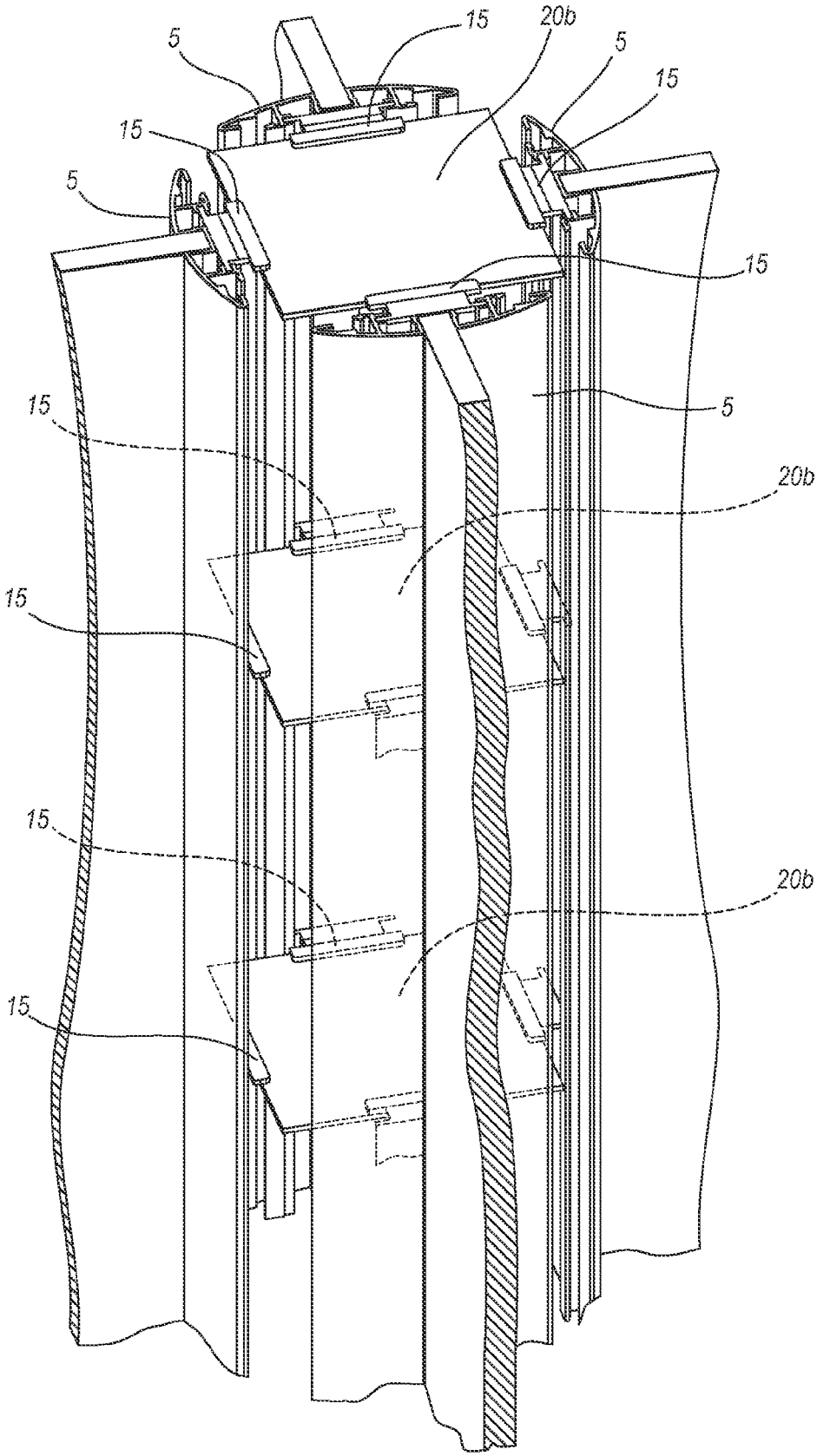
FIG. 2C illustrates an upside down perspective view of an assembled modular wall intersection created using a plurality of the variable angle connectors of FIGS. 2A-2B.

Of course, one will appreciate that the manufacturer can include any number of variable angle connectors 20 in a given virtual connector post 10. As previously mentioned, the manufacturer might secure a variable angle connector 10 to both the top and bottom of each given connector interface 5. Furthermore, such as where the custom connector 10 is particularly tall or particularly high, the manufacturer or assembler can also insert or otherwise connect one or more additional variable angle connectors 20*a* in a "mid span" position (e.g., at a point between the top and bottom positioned variable angle connectors). For example, FIG. 2C shows an upside down perspective view of an assembled connector post 10*b* with multiple variable angle connectors 10*b* positioned or otherwise secured therein. Accordingly, one will appreciate that a manufacturer or assembler can thus increase the stability of a given virtual connector post 10 with multiple different variable angle connectors 20.

Figure 3A:
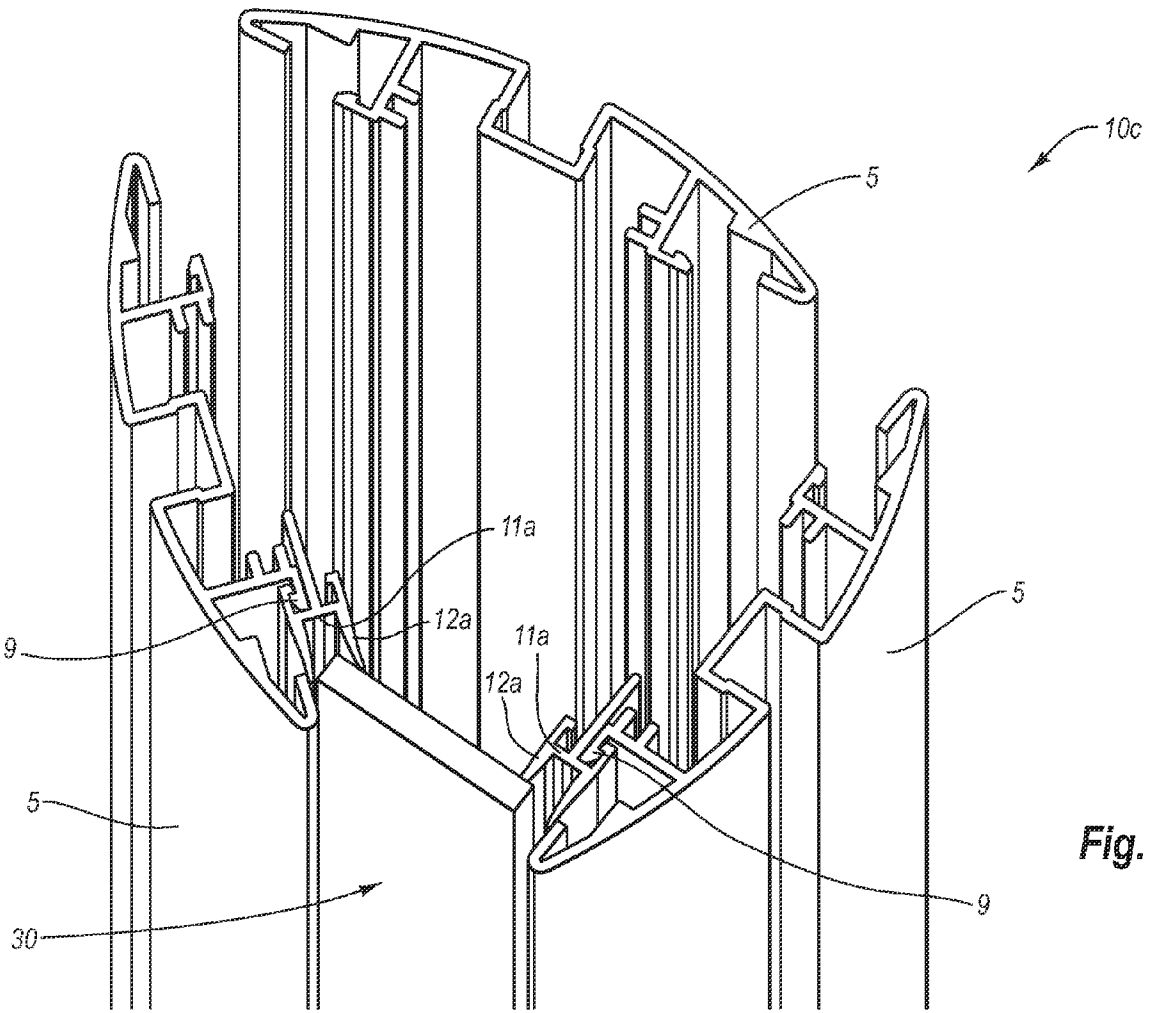
FIG. 3A illustrates an implementation of the present invention in which a concealing strip in accordance with at least one implementation of the present invention is used to seal the space between adjacent connector interfaces.

FIG. 3A illustrates a perspective view of still other types of finishing trim or sealing components that can be used to finish or seal a given virtual connector post (e.g., compared with gasket 7). In particular, FIG. 3A illustrates that a manufacturer or assembler can use a rigid concealing strip 30 to seal the space between adjacent connector interfaces. In the illustrated implementation, an exemplary concealing strip 30 can comprise any rigid material configured to span the spatial separation between adjacent connector interfaces 5. Of course, one will appreciate that other types or designs of concealing strips 30 can be used in accordance with implementations of the present invention.

Figure 3B:
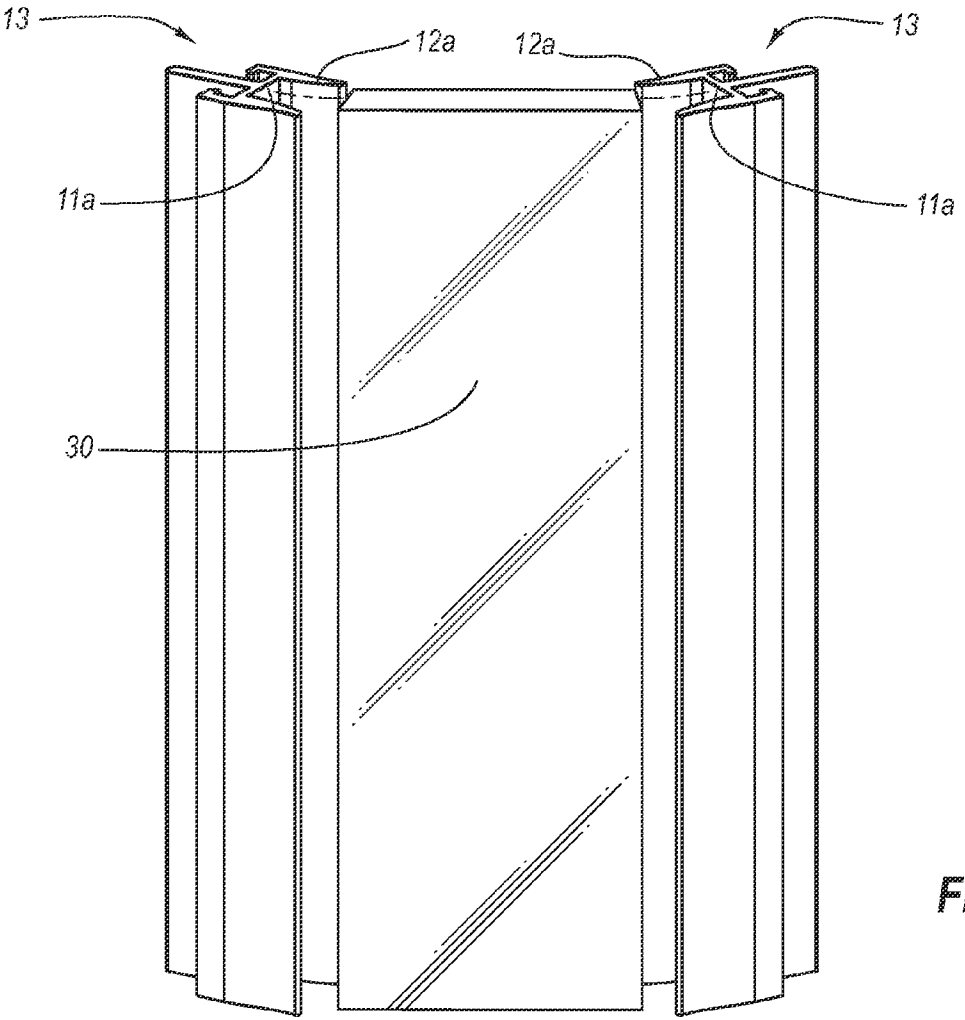
FIG. 3B illustrates an exploded view of the components used to assemble this implementation of the concealing strip of FIG. 3A.

In any event, the exploded view in FIG. 3B illustrates that this particular implementation of the concealing strip 30 can be assembled with a plurality of clip elements 13. For example, FIG. 3B shows that the plurality of clip elements 13 can comprise a set of walls 11*a* about which are positioned one or more gripping elements 12*a*. The one or more gripping elements 12*a* serve to grip the concealing strip 30 on one side, and on an opposing side, grip at least one rail 9 of a corresponding connector interface 5. Thus, and as with gasket 7, a manufacturer can combine the concealing strip 30 with the clip elements 13 (e.g., FIG. 3B), and attach the corresponding, opposed gripping elements 12*a* to the outside edges of rails 9, so that the concealing strip attaches two opposing connector interfaces 5 together. As with the gasket 7, the rigid concealing strip 30 thus fills in the space between adjacent connector interfaces 5, and provides a range of structural support and privacy functions.

In at least one implementation, however, concealing strip 30 and corresponding clip elements 13 are configured with the ability to span larger spaces between connector interfaces. In particular, and in contrast with flexible gasket 7, which is simply stretched or compressed to fill a given space, concealing strip is manufactured into a predefined width of virtually any size in order to be used in a given gap. That is, concealing strip 30 does not expand or contract, necessarily, to fill a space, but rather is chosen at the outset for its dimensions. In any case, and as also with gasket 7, one will appreciate that a concealing strip 30 can thus be made of virtually any number of synthetic or naturally occurring materials, including for example, wood, metallic, rubber, and plastic materials, or composites thereof. The choice of concealing strip 30 materials will typically be a function of the space to be spanned between adjacent connector interfaces, as well as the need to maintain a certain amount of rigidity, including any aesthetic concerns.

In view of the foregoing, one will appreciate that a manufacturer or assembler can create a wide range of different virtual connector posts 10 (or range of wall module intersections) simply by creating new shapes of variable angle connectors 20 to which wall modules can connect. In particular, the style and shape of a given virtual connector post 10 is limited primarily to the size and shape of any given set of variable angle connectors 20. For example, FIGS. 4A-4D illustrate various bottom views of possible virtual connector posts 10 that can be created in accordance with implementations of the present invention, which vary primarily due to the shape of the variable angle connector 20.

Figure 4A:
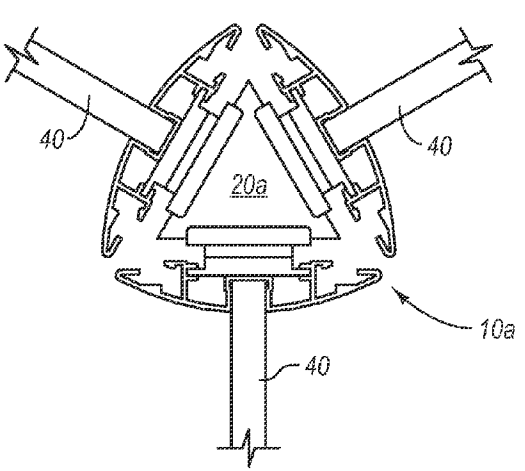
FIG. 4A illustrates a bottom view of a custom wall module intersection using a triangular variable angle connector in accordance with an implementation of the present invention.
Figure 4B:
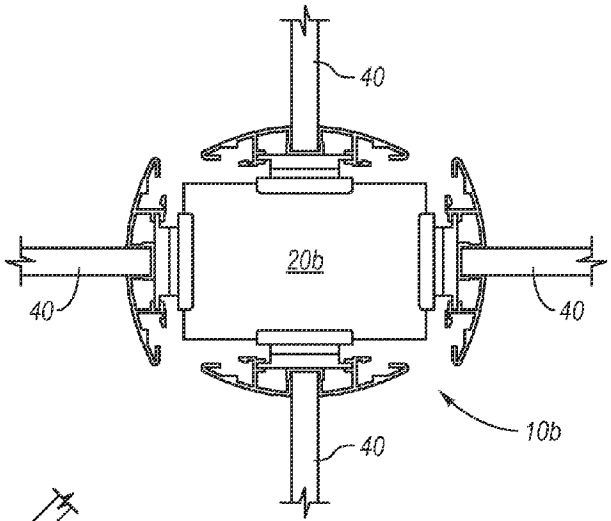
FIG. 4B illustrates a bottom view of a custom wall module intersection using a rectangular variable angle connector in accordance with an implementation of the present invention.
Figure 4C:
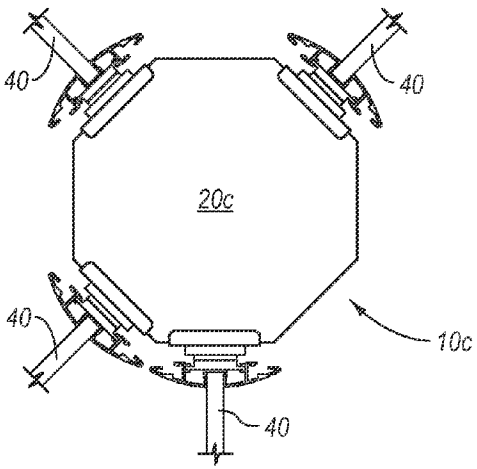
FIG. 4C illustrates a bottom view of a custom wall module intersection using an octagonal variable angle connector in accordance with an implementation of the present invention.
Figure 4D:
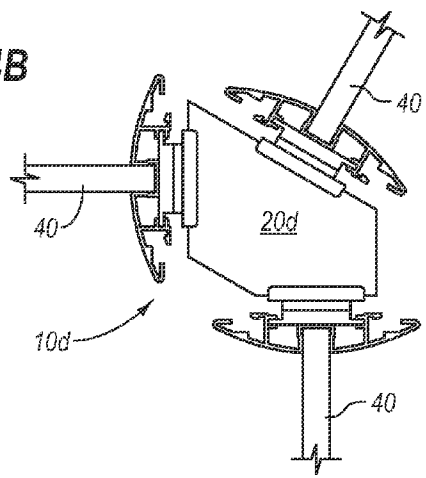
FIG. 4D a bottom view of a custom wall module intersection using a five-sided, customized variable angle connector in accordance with an implementation of the present invention.

For example, FIG. 4A illustrates a bottom view of a virtual connector post 10*a* that is created using triangular-shaped variable angle connector 20*a*. In addition, FIG. 4B illustrates a plan view of a rectangular-shaped virtual connector post 10*b* that is created using a variable angle connector 20*b*. By contrast, FIG. 4C is a bottom view of an octagon-shaped virtual connector post 10*c* that is created using an octagon-shaped variable angle connector 20*c*. Furthermore, FIG. 4D is a bottom view of an irregularly-shaped pentagonal variable angle virtual connector post 10*d* that is created using an irregularly-shaped pentagonal connector 20*d*. In each case, the virtual connector posts 10 comprise all of the same components, including attached wall modules 40, except for the variable angle connectors 20.

As such, FIGS. 4A-4C show that a manufacturer or assembler can create a wide range of partition designs in an interior or exterior space with relative ease. In particular, any time a manufacturer or assembler identifies a need for a customized wall module intersection, the manufacturer can quickly assemble a virtual connector post with the components illustrated or otherwise described herein. In such ease of assembly, the manufacturer is not limited to any particular shape or partitioning layout, other than what the manufacturer can create with a given set of one or more variable angle connectors.

The present invention may, therefore, be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an interior or exterior space in which a manufacturer or assembler partitions the space with one or more wall modules, a virtual connector post that can be configured and reconfigured for any angle by interchanging at least one component, comprising:

at least one variable angle connector having a shape comprising three or more facing sides;

a plurality of position retention mechanism arranged around a plurality of the facing sides; and a connector interface attached to each of the plurality of position retention mechanisms;

wherein the plurality of position retention mechanisms each comprise:

a first wall and an opposing second wall, wherein the first and second opposing walls form a plurality of opposing channels therebetween; and a plurality of spring tabs positioned within the opposing channels, the plurality of tabs being configured to releasably secure at least one connector interface to the variable angle connector.

2. In an interior or exterior space in which a manufacturer or assembler partitions the space with one or more wall modules, a virtual connector post that can be configured and reconfigured for any angle by interchanging at least one component, comprising:

at least one variable angle connector having a shape comprising three or more facing sides;

a plurality of position retention mechanism arranged around a plurality of the facing sides; and a connector interface attached to each of the plurality of position retention mechanisms;

wherein the plurality of position retention mechanisms each further comprises at least one right angle return projecting perpendicularly from the first or second walls.

3. The virtual connector post as recited in claim 2, wherein each of the right angle returns of the plurality of position retention mechanisms fixedly define a vertical position of the at least one variable angle connector.

4. In an interior or exterior space in which a manufacturer or assembler partitions the space with one or more wall modules, a virtual connector post that can be configured and reconfigured for any angle by interchanging at least one component, comprising:

at least one variable angle connector having a shape comprising three or more facing sides;

a plurality of position retention mechanism arranged around a plurality of the facing sides;

a connector interface attached to each of the plurality of position retention mechanisms; and at least one sealing component attached to each space formed between two adjacent connector interfaces;

wherein the at least one sealing component comprises a flexible gasket that that connects two adjacent connector interfaces, and extends an entire length of the connector interfaces.

5. A system configured to partition an interior or exterior space with a plurality of modular walls, wherein the plurality of modular walls can meet at arbitrarily-selected angles, comprising:

a set of one or more first variable angle connectors having a first shape;

a set of one or more second variable angle connectors having a second shape;

a plurality of position retention mechanisms; and a plurality of connector interfaces corresponding to each of the position retention mechanisms;

wherein the position retention mechanisms and the connector interfaces are configured for attachment to either the first or second variable angle connectors to create a virtual connector post corresponding to the shape of the first or second variable angle connectors; and wherein each of the plurality of position retention mechanisms is configured to releasably engage both a variable angle connector and a connector interface via at least one spring tab.

6. The system as recited in claim 5, wherein each of the plurality of position retention mechanisms comprises at least one right angle return projecting perpendicularly from the first or second walls of the position retention mechanism, wherein the right angle return fixedly defines a vertical position of at least one variable angle connector in a virtual connector post.

7. A system configured to partition an interior or exterior space with a plurality of modular walls, wherein the plurality of modular walls can meet at arbitrarily-selected angles, comprising:

a set of one or more first variable angle connectors having a first shape;

a set of one or more second variable angle connectors having a second shape;

a plurality of position retention mechanisms; and a plurality of connector interfaces corresponding to each of the position retention mechanisms;

wherein the position retention mechanisms and the connector interfaces are configured for attachment to either the first or second variable angle connectors to create a virtual connector post corresponding to the shape of the first or second variable angle connectors; and one or more sealing components configured to seal a space between adjacent vertical connector interfaces in a virtual connector post;

wherein at least one of the one or more sealing components comprises a flexible gasket configured to seal an arbitrary width between two adjacent connector interfaces along an entire length of the two adjacent connector interfaces.

8. In an interior or exterior space in which a manufacturer or assembler partitions the interior or exterior space with a plurality of modular walls at a plurality of different angles, a method of creating a customizable, reconfigurable virtual connector post for connecting the plurality of modular walls at the plurality of different angles, comprising:

determining a partition arrangement, the partition arrangement comprising a plurality of wall modules, at least some of the wall modules joining at an intersection having a first shape;

identifying a set of one or more variable angle connectors that are consistent with the first shape;

releasably attaching a plurality of position retention mechanisms to a plurality of sides on the one or more variable angle connectors;

releasably attaching a corresponding plurality of connector interfaces to each of the plurality of position retention mechanisms;

wherein the plurality of connector interfaces form a connector post that conforms to the first shape; and creating a new connector post with the plurality of position retention mechanisms and the connector interfaces by replacing the set of one or more variable angle connectors with a new set of one or more variable angle connectors that are consistent with a second shape.

9. The method as recited in claim 8, wherein replacing the set of one or more variable angle connectors comprises:

releasing a set of one or more spring tabs on each of the position retention mechanisms, wherein the set of one or more variable angle connectors consistent with the first shape and the connector interfaces are disengaged; and positioning a perpendicular tab of a new variable angle connector and a portion of a connector interface into a channel a plurality of the position retention mechanisms;

wherein the plurality of connector interfaces form a connector post that conforms to the second shape.

* * * * *

UNITED STATES PATENT AND TRADEMARK OFFICE

CERTIFICATE OF CORRECTION

PATENT NO. : 7,954,288 B2
APPLICATION NO. : 11/855363
DATED : June 7, 2011
INVENTOR(S) : Gosling et al.

It is certified that error appears in the above-identified patent and that said Letters Patent is hereby corrected as shown below:

Column 1
Line 51, change "can either free-standing" to --can either be free-standing--

Column 2
Line 47, change "mechanism" to --mechanisms--

Column 4
Line 8, after "FIG. 4D" insert --illustrates--

Column 5
Line 1, change "manufacturer" to --manufacture--
Lines 33-34, change "length of thereof" to --length thereof--

Column 7
Line 34, change "interface 5 rails 9" to --interface 5 of rails 9--

Column 9
Line 55, change "mechanism" to --mechanisms--

Column 10
Line 8, change "mechanism" to --mechanisms--
Line 27, change "mechanism" to --mechanisms--
Line 34, change "that that connects" to --that connects--

Signed and Sealed this
Third Day of January, 2012

David J. Kappos

David J. Kappos
*Director of the United States Patent and Trademark Office*